US012061001B2

(12) United States Patent
Sakarwala

(10) Patent No.: US 12,061,001 B2
(45) Date of Patent: Aug. 13, 2024

(54) DEVICES AND METHODS OF OPTIMIZING REFRIGERANT FLOW IN A HEAT EXCHANGER

(71) Applicant: Rheem Manufacturing Company, Atlanta, GA (US)

(72) Inventor: Ammar K. Sakarwala, Lewisville, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 233 days.

(21) Appl. No.: 17/223,116

(22) Filed: Apr. 6, 2021

(65) Prior Publication Data

US 2022/0316717 A1 Oct. 6, 2022

(51) Int. Cl.
*F24F 1/0067* (2019.01)
*F24F 5/00* (2006.01)

(52) U.S. Cl.
CPC ..... *F24F 1/0067* (2019.02); *F24F 5/0017* (2013.01); *F24F 2005/0025* (2013.01)

(58) Field of Classification Search
CPC ..... F25B 39/028; F24F 1/0067; F24F 5/0017; F24F 2005/0025; F24F 1/0068; F28F 27/02
See application file for complete search history.

(56) References Cited

U.S. PATENT DOCUMENTS 2,310,234 A 2/1943 Haug
4,093,024 A 6/1978 Middleton
5,101,887 A 4/1992 Kado
5,538,079 A 7/1996 Pawlick
5,689,881 A 11/1997 Kato
5,743,111 A * 4/1998 Sasaki ..... F25B 13/00 165/110
6,687,995 B1 2/2004 Sucke et al.
2001/0018970 A1 9/2001 Nakado et al.
(Continued)

FOREIGN PATENT DOCUMENTS

WO 2006083442 A2 8/2006

OTHER PUBLICATIONS

Most valves expand your refrigerant EcoFlow expands your options, advertisement for Danfoss EcoFlow, 2011, 8 pages.

*Primary Examiner* — Schyler S Sanks
(74) *Attorney, Agent, or Firm* — Eversheds Sutherland (US) LLP

(57) ABSTRACT

The disclosed technology includes devices and methods for optimizing refrigerant flow in a heat exchanger. The disclosed technology can include a heat exchanger unit that has a first heat exchanger coil that experiences a first airflow of air passing over the first heat exchanger coil and a second heat exchanger coil that experiences a second airflow of air passing over the second heat exchanger coil. The first airflow can be less than the second air flow. The disclosed technology can include distributor tubes in fluid communication with the heat exchanger coils to direct a flow of refrigerant from an expansion valve to the heat exchanger coils. The first distributor tube can reduce a flow rate of refrigerant to the first heat exchanger coil such that a greater amount of refrigerant is directed to the second heat exchanger coil and refrigerant exits each heat exchanger coil as a superheated vapor.

13 Claims, 7 Drawing Sheets

(56) References Cited

U.S. PATENT DOCUMENTS

| | | | | |
|---|---|---|---|---|
| 2013/0111946 | A1* | 5/2013 | Thybo | F25B 41/31 62/528 |
| 2018/0112900 | A1* | 4/2018 | Goel | G01K 1/16 |
| 2020/0072483 | A1* | 3/2020 | Snider | F24F 11/30 |
| 2020/0200477 | A1* | 6/2020 | Satou | F28D 1/0417 |

* cited by examiner

DEVICES AND METHODS OF OPTIMIZING REFRIGERANT FLOW IN A HEAT EXCHANGER

FIELD OF TECHNOLOGY

The disclosed technology relates generally to heat exchanger units used in a refrigerant vapor compression cycle for air conditioning and refrigeration systems.

BACKGROUND

Heat exchanger coils are commonly used in air conditioning, heat pump, and refrigeration systems as part of a refrigerant vapor compression cycle. In particular, air conditioning and heat pump systems often include a heat exchanger coil that is arranged to facilitate heat transfer between the heat exchanger coil and air, such as an N-coil or an A-coil configuration. Undesirably, the angles of the heat exchanger coil slabs, and the inclusion of other components (e.g., the drain pan, the mounting brackets, the piping, etc.) can lead to maldistribution of the airflow across the heat exchanger coil slabs to the point that some heat exchanger coils (sometimes referred to as heat exchanger circuits) are starved of airflow. The heat exchanger coils that are starved of airflow are unable to effectively transfer heat between the air and the refrigerant such that some heat exchanger coils exhibit two-phase refrigerant exiting the heat exchanger coil. Furthermore, some heat exchangers can be arranged such that some heat exchanger coils are longer than others, which might lead to two-phase refrigerant exiting some of the heat exchanger coils. Two-phase refrigerant has a higher heat transfer coefficient than single-phase refrigerant and ideally, all refrigerant exiting the coil should be single phase vapor for efficient operation of the heat exchanger. Hence, any two-phase refrigerant exiting the coil can lead to inefficient operation of the heat exchanger.

To illustrate, FIG. 1 depicts an existing heat exchanger unit 100 having an N-coil heat exchanger design with three heat exchanger coil slabs 102. Each of the heat exchanger coil slabs 102 has two heat exchanger circuits or coils (i.e., heat exchanger coils 104A-104F). Because of the arrangement of the heat exchanger coil slabs 102, airflow distribution is uneven across the heat exchanger coil slabs 102 such that the refrigerant exiting five of the heat exchanger coils (e.g., heat exchanger coils 104A-104E) exits in vapor form but the refrigerant exiting at least one heat exchanger coil (e.g., heat exchanger coil 104F) exits as a two-phase refrigerant. Thus, in the current configuration, the maldistribution of air across the heat exchanger coils 104 causes the heat exchanger unit 100 to be less effective in transferring heat between the refrigerant and the air.

One method of ensuring the refrigerant exits each heat exchanger coil 104A-104F as a single-phase vapor is to change the configuration of the heat exchanger coil slabs 102 such that the air is evenly distributed across the heat exchanger coils 104A-104F. Changing the configuration of the heat exchanger coil slabs 102, however, can require an extensive and expensive re-design of the heat exchanger unit 100 and could potentially create other performance issues (e.g., insufficient drainage of condensate). Thus, changing the configuration of the heat exchanger coil slabs 102 is often not a viable option for ensuring the refrigerant exits each heat exchanger coil 104A-104F as a single-phase vapor.

What is needed, therefore, is a device and method that can increase the overall efficiency of the heat exchanger unit by ensuring each of the heat exchanger coils can facilitate heat transfer between the refrigerant and the air such that the refrigerant exits each of the heat exchanger coils as a single-phase vapor.

These and other problems are addressed by the technology disclosed herein.

SUMMARY

The disclosed technology relates generally to heat exchanger units used in a refrigerant vapor compression cycle for air conditioning and refrigeration systems. The disclosed technology can include a heat exchanger unit that can have a plurality of heat exchanger coils. A first heat exchanger coil of the plurality of heat exchanger coils can be disposed at a first location such that the first heat exchanger coil experiences a first airflow of air passing over the first heat exchanger coil. A second heat exchanger coil of the plurality of heat exchanger coils can be disposed at a second location such that the second heat exchanger coil experiences a second airflow of air passing over the second heat exchanger coil. The first airflow can be less than the second airflow.

The heat exchanger unit can also have a plurality of distributor tubes. Each of the distributor tubes can be in fluid communication with a corresponding heat exchanger coil and be configured to direct a flow of refrigerant from an expansion valve to the corresponding heat exchanger coil.

The heat exchanger unit can also have a first distributor tube that is configured to reduce a flow rate of refrigerant from the expansion valve to the first heat exchanger coil such that a greater amount of refrigerant is directed to the second heat exchanger coil and refrigerant exits each heat exchanger coil as a superheated vapor refrigerant.

The first distributor tube can be longer than a second distributor tube, have a greater number of bends than a number of bends in a second distributor tube of the plurality of distributor tubes, and/or have a smaller inner diameter than a second distributor tube of the plurality of distributor tubes. Alternatively, or in addition, the first distributor tube can comprise a constriction. The constriction can be a reduced cross-sectional area of the first distributor tube of the plurality of distributor tubes or the constriction can be a flow orifice. If the constriction is a flow orifice, the flow orifice can be a single-stage flow orifice or a multi-stage flow orifice. Alternatively, or in addition, the first distributor tube can include a valve that is configured to change a cross-sectional area of a flow path from the expansion valve to the heat exchanger coil.

The disclosed technology can include an air conditioning system that has a compressor, a condenser unit, an expansion valve, and an evaporator unit in fluid communication with the compressor, the condenser unit, and the expansion valve.

The evaporator unit can include a plurality of heat exchanger coils. A first heat exchanger coil of the plurality of heat exchanger coils can be disposed at a first location such that the first heat exchanger coil experiences a first airflow of air passing over the first heat exchanger coil. A second heat exchanger coil of the plurality of heat exchanger coils can be disposed at a second location such that the second heat exchanger coil experiences a second airflow of air passing over the second heat exchanger coil. The first airflow can be less than the second airflow.

The heat exchanger unit can also have a plurality of distributor tubes. Each of the distributor tubes can be in fluid communication with a corresponding heat exchanger coil and be configured to direct a flow of refrigerant from an expansion valve to the corresponding heat exchanger coil.

The heat exchanger unit can also have a first distributor tube that is configured to reduce a flow rate of refrigerant from the expansion valve to the first heat exchanger coil such that a greater amount of refrigerant is directed to the second heat exchanger coil and refrigerant exits each heat exchanger coil as a superheated vapor refrigerant.

The first distributor tube can be longer than a second distributor tube, have a greater number of bends than a number of bends in a second distributor tube of the plurality of distributor tubes, and/or have a smaller inner diameter than a second distributor tube of the plurality of distributor tubes. Alternatively, or in addition, the first distributor tube can comprise a constriction. The constriction can be a reduced cross-sectional area of the first distributor tube of the plurality of distributor tubes or the constriction can be a flow orifice. If the constriction is a flow orifice, the flow orifice can be a single-stage flow orifice or a multi-stage flow orifice. Alternatively, or in addition, the first distributor tube can include a valve that is configured to change a cross-sectional area of a flow path from the expansion valve to the heat exchanger coil.

A second distributor tube of the plurality of distributor tubes can be shorter than the first distributor tube and a third distributor tube. The third distributor tube can be in fluid communication with a third heat exchanger coil of the plurality of heat exchanger coils.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate the presently disclosed subject matter and serve to explain the principles of the presently disclosed subject matter. The drawings are not intended to limit the scope of the presently disclosed subject matter in any manner.

DETAILED DESCRIPTION

Figure 1:
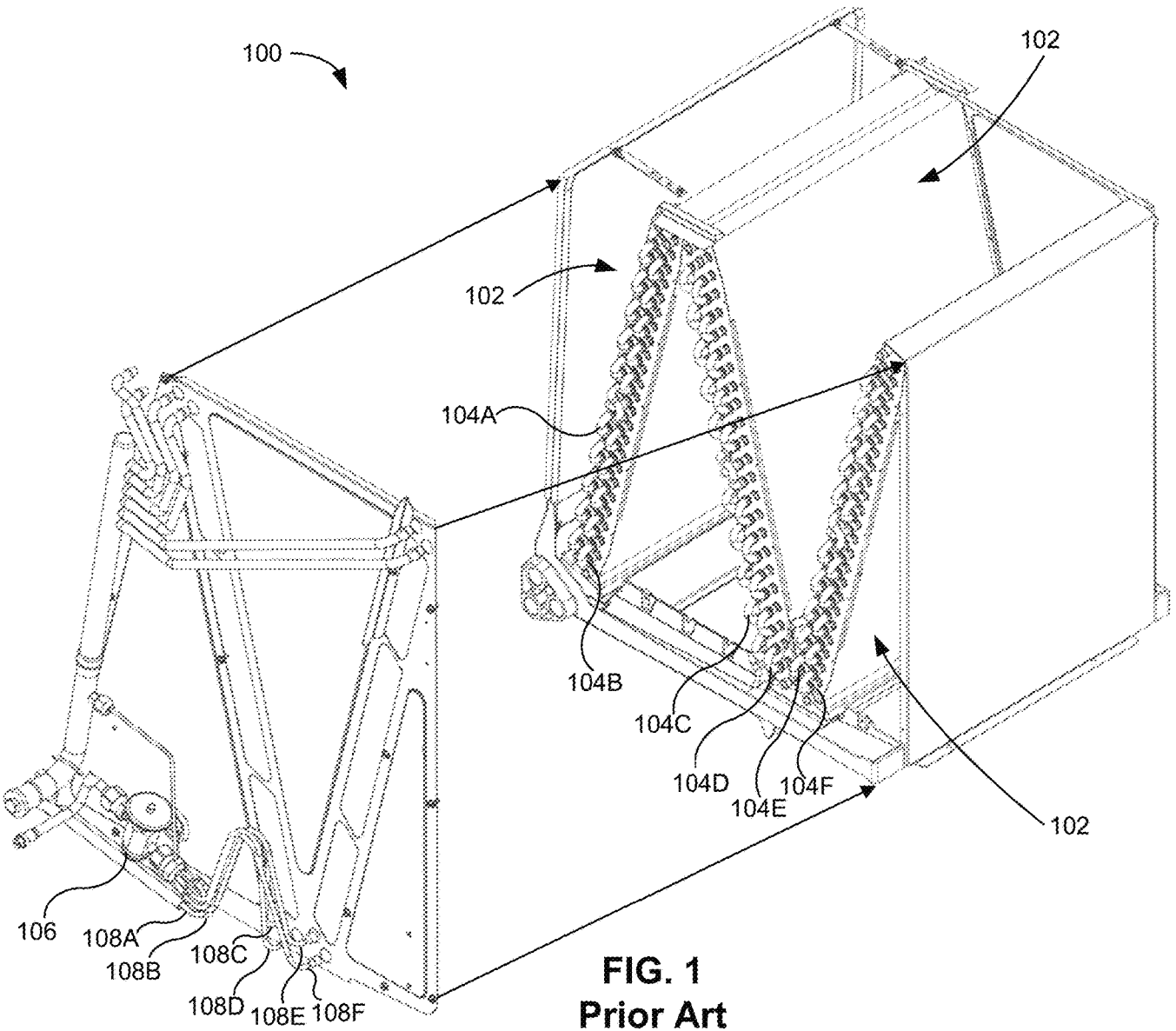
FIG. 1 Prior Art
FIG. 1 illustrates a heat exchanger unit of an air conditioning system, in accordance with heat exchanger units currently known in the art.

The disclosed technology relates generally to heat exchanger units used in a refrigerant vapor compression cycle for air conditioning and refrigeration systems. The disclosed technology can increase the overall efficiency of a heat exchanger unit by directing refrigerant flow away from heat exchanger coils that are starved of airflow and toward heat exchanger coils that receive a greater amount of airflow. In this way, the disclosed technology can increase the heat exchanger unit's ability to effectively facilitate heat transfer between the air and the refrigerant such that the refrigerant exits all of the heat exchanger coils as a single-phase vapor refrigerant rather than a two-phase refrigerant. The disclosed technology can include introducing a pressure differential between heat exchanger coils by changing the distributor tube configuration to increase or reduce a pressure drop in at least one of the distributor tubes. The disclosed technology can include lengthening a distributor tube, shortening a distributor tube, introducing a constriction in a distributor tube, and/or introducing one or more bends into the distributor tube to create a pressure differential between heat exchanger coils. The resulting pressure differential can cause refrigerant to flow away from heat exchanger coils that are starved of airflow and toward heat exchanger coils that have greater airflow, resulting in an overall increase in efficiency of the heat exchanger unit.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of being devices and methods for use with a heat exchanger unit of an air conditioning system. The present disclosure, however, is not so limited, and can be applicable in other contexts. The present disclosure can include devices and systems for use with heat pumps and refrigeration systems that utilize heat exchanger coils that exhibit maldistribution of heat transfer across the heat exchanger coils. Furthermore, the present disclosure can include heat exchanger units that transfer heat between a fluid other than air such as air conditioning or refrigeration systems that use nitrogen, argon, helium, hydrogen, water vapor, water, glycol, silicone oil, hydrocarbons, salt brines, or any other suitable type of heat transfer fluid. Such implementations and applications are contemplated within the scope of the present disclosure. Accordingly, when the present disclosure is described in the context of being devices and systems for use with heat exchanger unit of an air conditioning system, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

As used herein, the phrase "starved of airflow" and its variants when referred to airflow around a heat exchanger coil can include a complete lack of airflow or any reduction in airflow when compared to other heat exchanger coils of a given heat exchanger unit. Thus, the phrase "starved of airflow" should not be limited to include only situations where a heat exchanger coil experiences a complete lack of airflow. Furthermore, the phrase can include other heat transfer fluids other than air. "Starved of airflow" can be descriptive of heat exchanger coils that receive a decreased flow of nitrogen, argon, helium, hydrogen, water vapor, water, glycol, silicone oil, hydrocarbons, salt brines, or any other suitable type of heat transfer fluid. Thus, the phrase "starved of airflow" and its variants should not be construed as limited to only heat exchanger coils configured to transfer heat between air and refrigerant. Furthermore, although the phrase "starved of airflow" and its variants are used herein to illustrate a condition that can cause maldistribution of refrigerant through heat exchanger coils, one of skill in the art will appreciate that other conditions can cause maldistribution of refrigerant through heat exchanger coils including, but not limited to, unequal lengths of the heat exchanger coils.

Referring now to the drawings, in which like numerals represent like elements, the present disclosure is herein described. As illustrated in FIG. 1, and briefly described previously, an existing heat exchanger unit 100 can include an N-coil heat exchanger design with three heat exchanger coil slabs 102. As will be appreciated by one of skill in the art, the various components herein described can be part of a refrigerant cycle configured to transfer heat between the heat exchanger unit 100 and a connected heat exchanger unit (not shown) by cycling a refrigerant through the heat exchanger unit 200 and the connected heat exchanger unit (not shown). Each of the heat exchanger coil slabs 102 can have two heat exchanger coils 104 (shown as heat exchanger coils 104A-104F). The heat exchanger coils 104A-104F can each receive refrigerant from a thermal expansion valve (TXV) 106 by distributor tubes 108A-108F that direct the refrigerant to the heat exchanger coils 104A-104F (the distributor tubes 108A-108F are depicted as being disconnected from the heat exchanger tubes 104A-104F for illustrative purposes). Each distributor tube 108A-108F can be connected to a corresponding heat exchanger coil 104A-104F to direct the refrigerant from the TXV 106 to the corresponding heat exchanger coil 104A-104F. Distributor tube 108A can be connected to heat exchanger coil 104A such that distributor tube 108A can direct refrigerant from the TXV 106 to the heat exchanger coil 104A, distributor tube 108B can be connected to heat exchanger coil 104B such that distributor tube 108B can direct refrigerant from the TXV 106 to the heat exchanger coil 104B, and so forth with each of heat exchanger coils 104C-104F and distributor tubes 108C-108F. The distributor tubes 108A-108F are configured to direct the same or approximately the same amount of refrigerant to each of the corresponding heat exchanger coils 104A-104F such that each heat exchanger coil 104A-104F receives roughly the same amount of refrigerant.

Although described as a thermal expansion device, the TXV 106 can be any type of expansion device that is suitable for the application. The TXV 106 can be a thermal expansion valve, an electronic expansion valve, a capillary tube expansion device, or any other suitable expansion device for the application. The TXV 106 can be internally equalized or externally equalized. Furthermore, the TXV 106 can include a check valve and/or be part of an expansion device and check valve assembly.

As previously described, the heat exchanger coil slabs 102 are arranged such that airflow distribution can be uneven across the heat exchanger coil slabs 102. The uneven airflow distribution can cause the refrigerant exiting five of the heat exchanger coils 104A-104E to exit as a superheated vapor while the refrigerant exiting one heat exchanger coil (i.e., heat exchanger coil 104F) exits as a two-phase liquid-vapor refrigerant. Thus, in the configuration depicted in FIG. 1, the maldistribution of air across the heat exchanger coils 104 causes the heat exchanger unit 100 to be less efficient in transferring heat between the refrigerant and the air. Similarly, in a heat exchanger unit 100 having heat exchanger coils 104A-104E of unequal length (i.e., at least one of the heat exchanger coils 104F is a different length than the length of the other heat exchanger coils 104A-104E), the refrigerant will be unevenly distributed through the heat exchanger coils 104A-104F, and two-phase liquid-vapor may exit one or more of the heat exchanger coils 104A-104F. For example, if the heat exchanger coil 104F is a shorter length than the other heat exchanger coils 104A-104E, a greater amount of refrigerant will flow through heat exchanger coil 104F because the refrigerant will encounter less cumulative frictional force through the heat exchanger coil 104F. Because a greater amount of refrigerant will flow through heat exchanger coil 104F, the refrigerant may not be properly superheated and can exit the heat exchanger coil 104F as a two-phase liquid-vapor refrigerant. In this configuration, the unequal lengths of heat exchanger coils 104A-104F can cause the heat exchanger unit 100 to be less efficient in transferring heat between the refrigerant and the air. The disclosed technology can be used to offset (e.g., via the distributor tubes 208A-208F) maldistribution of refrigerant through different heat exchanger coils 104A-104F such that each heat exchanger coil 104A-104F can facilitate proper superheating of the refrigerant.

Figure 2:
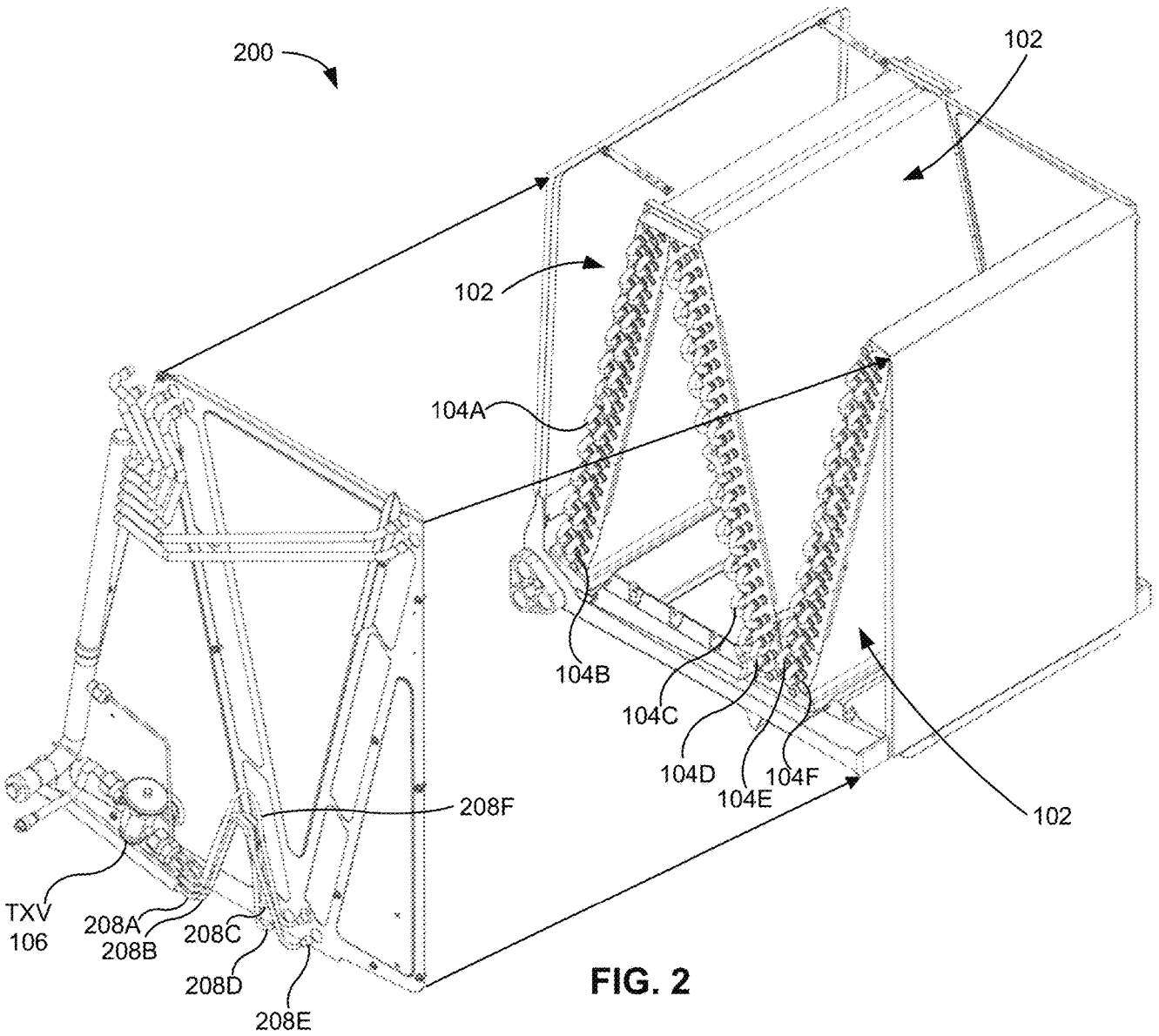
FIG. 2 illustrates a heat exchanger unit of an air conditioning system, in accordance with the disclosed technology.

FIG. 2 illustrates a heat exchanger unit 200 according the present disclosure. As described herein, heat exchanger unit 200 can be a heat exchanger unit configured to facilitate heat transfer between ambient air and refrigerant such that the refrigerant enters the heat exchanger unit 200 as a two-phase liquid-vapor refrigerant and exits the heat exchanger unit 200 as a single-phase vapor refrigerant. The heat exchanger unit 200 can be an evaporator unit of an air conditioning system. The heat exchanger unit 200 can be installed in any suitable location for the application. The heat exchanger unit 200 can be installed inside of a home, a building, or other space intended to be cooled by air directed across the heat exchanger unit 200. Alternatively, the heat exchanger unit 200 can be installed outside of a building and be used with a heat pump system such that the heat exchanger unit 200 acts as an evaporator unit when the heat pump system is in a heating mode.

The heat exchanger unit 200 can be configured to overcome the inefficiencies of the heat exchanger unit 100 by being configured such that the refrigerant exits all of the heat exchanger coils 104A-104F as a single-phase vapor refrigerant rather than a two-phase liquid-vapor refrigerant. The heat exchanger unit 200 can include distributor tubes 208A-208F that can control a flow of the refrigerant through the various heat exchanger coils 104A-104F. The distributor tubes 208A-208F can be similar to the distributor tubes 108A-108F previously described, but can be configured to cause a pressure differential between the various distributor tubes 208A-208F such that less refrigerant is directed toward a heat exchanger coil 104A-104F that is starved of airflow (e.g., heat exchanger coil 104F). In this way, a greater amount of refrigerant can be directed to the remaining heat exchanger coils (e.g., 104A-104E) that are configured to facilitate a greater amount of heat transfer such that more refrigerant exits the heat exchanger unit 200 as a single-phase vapor refrigerant. Furthermore, because less refrigerant is directed through the heat exchanger coil 104F that is starved of airflow, the lesser amount of refrigerant can absorb enough heat energy such that the refrigerant in the heat exchanger coil 104A-104F that is starved of airflow also exits the heat exchanger unit 200 as a single-phase vapor refrigerant.

As will become apparent throughout this disclosure, the disclosed technology includes several variations of distributor tubes 208A-208F. Each variation of distributor tubes 208A-208F described herein is capable of causing a greater amount of refrigerant to flow through heat exchanger coils 104A-104F that receive greater airflow and a lesser amount of refrigerant to flow through heat exchanger coils 104A-104F that are starved of airflow. In this way, the disclosed technology can ensure a suitable amount of refrigerant is directed through the heat exchanger coils 104A-104F such that each heat exchanger coil 104A-104F can cause refrigerant to exit the heat exchanger coil 104A-104F as a single-phase vapor refrigerant.

Figure 3:
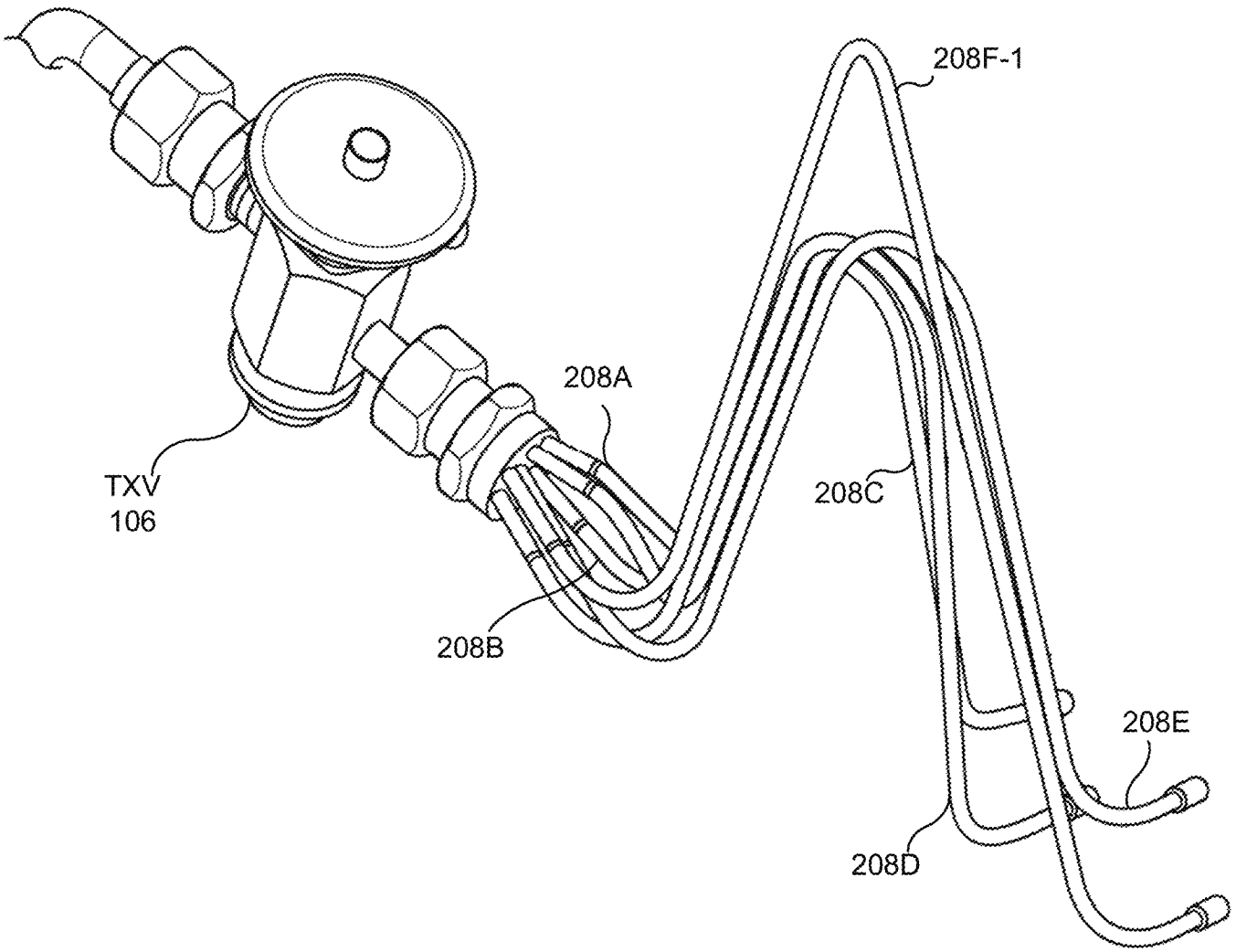
FIG. 3 illustrates a thermal expansion valve and set of distributor tubes, in accordance with the disclosed technology.

FIG. 3 illustrates a set of distributor tubes 208A-208F with only the TXV 106 and the distributor tubes 208A-208F shown for illustrative purposes. The distributor tubes 208A-208F can be capable of causing a greater amount of refrigerant to flow through heat exchanger coils 104A-104F that receive greater airflow and a lesser amount of refrigerant to flow through heat exchanger coils 104A-104F that are starved of airflow. As illustrated in FIG. 3, one or more distributor tubes (e.g., distributor tube 208F-1 in FIG. 3) can be longer than one or more other distributor tubes (e.g., 208A-208E in FIG. 3). When distributor tube 208F-1 is longer than the remaining distributor tubes 208A-208E, the refrigerant flowing through distributor tube 208F-1 experiences greater resistive force while flowing through distributor tube 208F-1 and, as a result, less refrigerant flows through distributor tube 208F-1 than the other distributor tubes 208A-208E. Furthermore, by this arrangement, distributor tube 208F-1 causes greater amounts of refrigerant to flow through the remaining distributor tubes 208A-208E as compared to a scenario in which all distributor tubes 208 have the same or approximately the same length. As will be appreciated by one of skill in the art, distributor tube 208F-1 can be connected to a heat exchanger coil (e.g., heat exchanger coil 104F) that is disposed in the heat exchanger unit 200 at a location that is starved of airflow or otherwise receives less airflow as compared to other heat exchanger coils. Furthermore, distributor tubes 208A-208E can be connected to heat exchanger coils (e.g., heat exchanger coils 104A-104E) that are arranged in the heat exchanger unit 200 such that they receive a greater amount of airflow as compared to heat exchanger coil 104F (which corresponds to distributor tube 208F-1). Thus, by lengthening distributor tube 208F-1 to cause greater refrigerant to flow through the heat exchanger coils 104A-104E, which receive greater airflow, and less refrigerant to flow through heat exchanger coil 104F, which is comparatively starved of airflow, distributor tube 208F-1 can help to increase the overall efficiency of the heat exchanger unit 200.

The length of distributor tube 208F-1 can be adjusted to accommodate the flow rate of the refrigerant passing through the heat exchanger coils 104A-104F and the flow rate of the air passing around heat exchanger coils 104A-104F. In other words, the length of distributor tube 208F-1 can be adjusted (i.e., lengthened or shortened) until single-phase vapor refrigerant exits each of the heat exchanger coils 104A-104F. The length of the distributor tube 208F-1 can be adjusted by the manufacturer during manufacture of the heat exchanger unit 200 and/or adjusted or replaced (e.g., with a distributor tube of a different length) by a technician during installation or maintenance of the heat exchanger unit 200.

FIGS. 4A-5D depict additional examples of distributor tubes 208A-208F in accordance with the disclosed technology, showing only the TXV 106 and the distributor tubes 208A-208F for illustrative purposes. For simplicity in showing the variations of the distributor tubes 208A-208F, FIGS. 4A-5A show only the TXV 106 as a representative block and only a few of distributor tubes 208A-208F attached thereto. Thus, distributor tubes 208A-208E are shown only as two representative distributor tubes for clarity of illustration, such that emphasis can be given to the variation of distributor tube 208F. Furthermore, as will be appreciated by one of skill in the art, although described as being only distributor tube 208F which has a varying configuration, the configuration of some or all of distributor tubes 208A-208E can also be varied to fit the particular application. Further still, a heat exchanger unit 200 can include some or all of the variations described in relation to FIGS. 2-5D on either a single distributor tube 208F or some or all of distributor tubes 208A-208F. That is, any combination of the distributor tubes 208 described herein can be made to achieve the desired refrigerant flow amounts and/or rates through the corresponding heat exchanger coils 104. Further, while examples are illustrated as including a specific number of distributor tubes 208A-208F and corresponding heat exchanger coils 104A-104F, it is contemplated that the disclosed technology can include any number of distributor tubes 208 and heat exchanger coils 104.

Figure 4A:
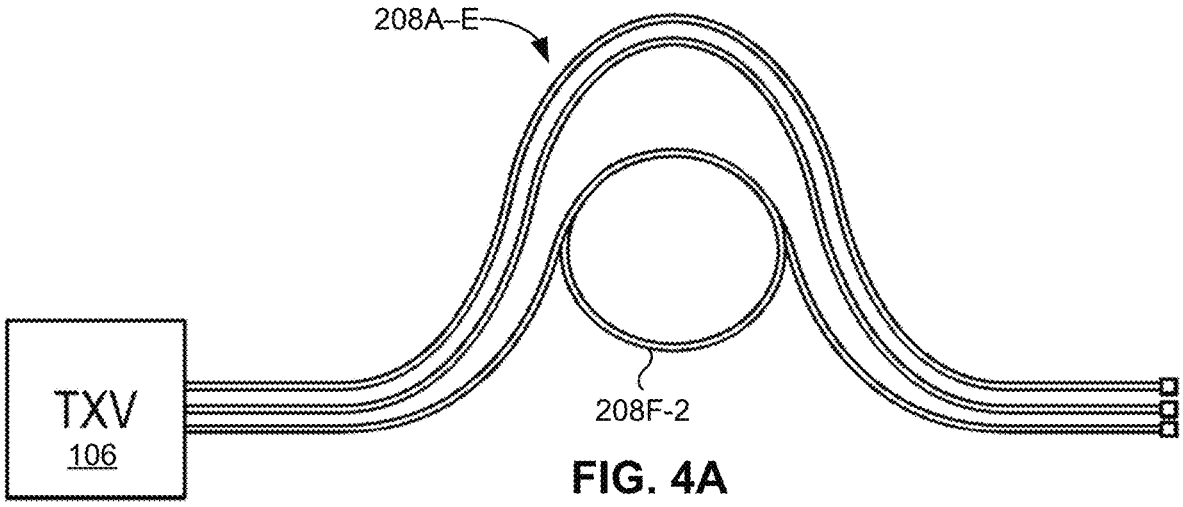
FIGS. 4A-4E illustrate distributor tubes, in accordance with the disclosed technology.

FIG. 4A illustrates a distributor tube 208F-2 that has a greater length than the other distributor tubes 208A-208E. The distributor tube 208F-2 can have all of the same characteristics as those previously described in relation to distributor tube 208F-1. Alternatively or in addition, the distributor tube 208F-2 can be curled to form a loop to accommodate the longer length of distributor tube 208F-2. The loop can have any desired diameter. Distributor tube 208F-2 can have a single loop or multiple loops (e.g., forming a helical configuration). Each loop can have the same diameter. Alternatively, one or more loops can have a diameter that is different from the diameter of one or more other loops. Similar to distributor tube 208F-1, distributor tube 208F-2 can be configured to cause a greater amount of refrigerant to flow through heat exchanger coils 104A-104E and a lesser amount of refrigerant to flow through heat exchanger 104F which is starved of airflow.

Similar to distributor tube 208F-1, the length of distributor tube 208F-2 can be adjusted to accommodate the flow rate of the refrigerant passing through the heat exchanger coils 104A-104F and the flow rate of the air passing around heat exchanger coils 104A-104F. In other words, the length of distributor tube 208F-2 can be adjusted (i.e., lengthened or shortened) until single-phase vapor refrigerant exits each of the heat exchanger coils 104A-104F. For example, the length of the distributor tube 208F-2 can be adjusted by operating the heat exchanger unit 200 and detecting whether single phase vapor refrigerant is exiting each of the heat exchanger coils 104A-104F. If it is determined that two phase refrigerant is exiting at least one of the heat exchanger coils 104A-104F, the length of the distributor tube 208F-2 can be lengthened or shortened to cause more or less refrigerant to pass through the other distributor tubes 208A-208E. The length of the distributor tube 208F-2 can be adjusted by the manufacturer during manufacture of the heat exchanger unit 200 and/or adjusted or replaced by a technician during installation or maintenance of the heat exchanger unit 200.

Figure 4B:
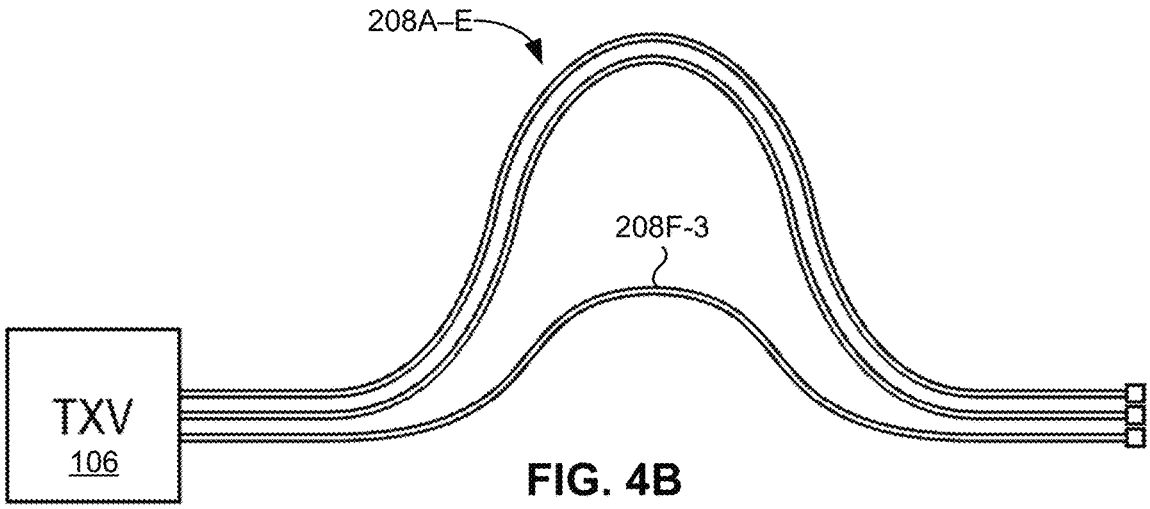

As illustrated in FIG. 4B, a distributor tube (i.e., distributor tube 208F-3) can have a shorter length than distributor tubes 208A-208E. Distributor tube 208F-3 can be connected to a heat exchanger coil (e.g., heat exchanger coil 104F) that can be configured to receive a greater amount of airflow than other heat exchanger coils 104A-104E. Furthermore, at least one other heat exchanger coil (e.g., one of heat exchanger coils 104A-104E) can be disposed in a location that is starved of airflow. As will be appreciated by one of skill in the art, because distributor tube 208F-3 is shorter than distributor tubes 208A-208E, the refrigerant flowing through distributor tube 208F-3 experiences less restrictive force and can therefore accommodate a greater flow rate of refrigerant flowing through distributor tube 208F-3. In this way, more refrigerant can flow through distributor tube 208F-3, which is configured to receive a greater amount of airflow, while a comparatively smaller amount of refrigerant can flow through the other distributor tubes 208A-208E, at least one of which can be starved of airflow. Thus, the heat exchanger coils 104A-104E that are starved of airflow can have a comparatively smaller amount of refrigerant flowing through them and can therefore facilitate sufficient heat transfer between the refrigerant and the ambient air such that the refrigerant can exit the heat exchanger coils 104A-104E as a single-phase vapor refrigerant. Accordingly, the heat exchanger unit 200 can achieve a greater overall efficiency because the refrigerant exiting each of heat exchanger coils 104A-104F exits as a single-phase vapor refrigerant.

Similar to distributor tubes 208F-1 and 208F-2, the length of distributor tube 208F-3 can be adjusted to accommodate the flow rate of the refrigerant passing through the heat exchanger coils 104A-104F and the flow rate of the air passing around heat exchanger coils 104A-104F. In other words, the length of distributor tube 208F-3 can be adjusted (i.e., lengthened or shortened) until single-phase vapor refrigerant exits each of the heat exchanger coils 104A-104F. The length of the distributor tube 208F-3 can be adjusted by the manufacturer during manufacture of the heat exchanger unit 200 and/or adjusted or replaced by a technician during installation or maintenance of the heat exchanger unit 200.

Figure 4C:
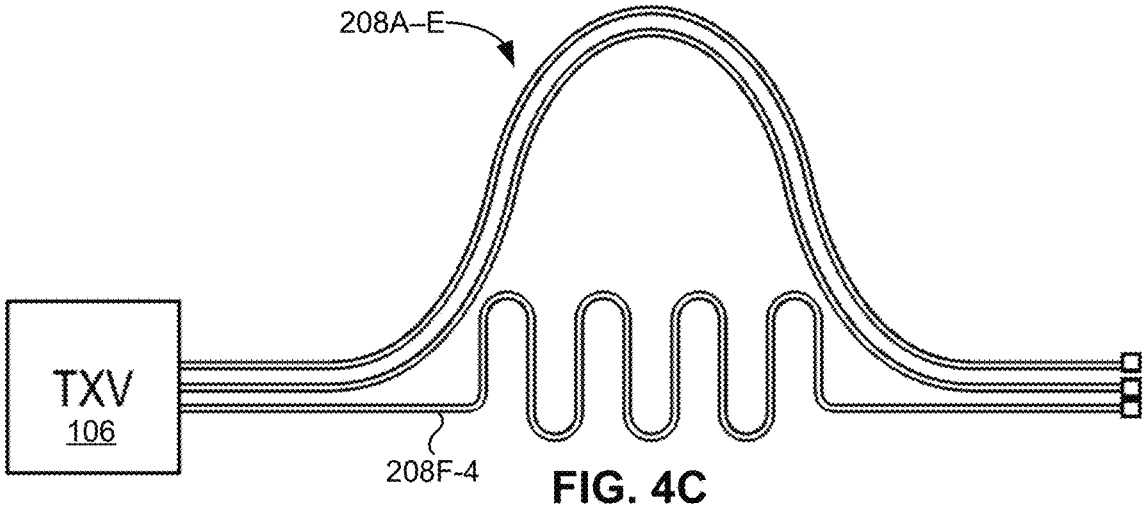

FIG. 4C illustrates a distributor tube (i.e., distributor tube 208F-4) that includes more bends than the other distributor tubes (i.e., distributor tubes 208A-208E). Distributor tube 208F-4 can be connected to a heat exchanger coil (e.g., heat exchanger coil 104F) that is starved of airflow. As will be appreciated by one of skill in the art, direction changes in a distributor tube 208 can restrict flow. Thus, by including a greater number of bends in distributor tube 208F-4, the refrigerant flowing through distributor tube 208F-4 can experience greater restrictive forces. Accordingly, distributor tube 208F-4 can cause a lesser amount of refrigerant to flow through distributor tube 208F-4 and a greater amount of refrigerant to flow through distributor tubes 208A-208E. Distributor tube 208F-4 can have the same length as distributor tubes 208A-208E. Alternatively, distributor tube 208F-4 can be longer or shorter than distributor tubes 208A-208E. Furthermore, the number of bends, the bend radius (or angle, if the bend is not rounded) of each bend, and the location of each of the bends in distributor tube 208F-4 can be varied to ensure single-phase vapor refrigerant exits each of the heat exchanger coils 104A-104F.

Similar to distributor tubes 208F-1, 208F-2, and 208F-3, the length of distributor tube 208F-4 can be adjusted to accommodate the flow rate of the refrigerant passing through the heat exchanger coils 104A-104F and the flow rate of the air passing around heat exchanger coils 104A-104F. In other words, the length of distributor tube 208F-4 can be adjusted (i.e., lengthened or shortened) until single-phase vapor refrigerant exits each of the heat exchanger coils 104A-104F. The length of the distributor tube 208F-4 can be adjusted by the manufacturer during manufacture of the heat exchanger unit 200 and/or adjusted or replaced by a technician during installation or maintenance of the heat exchanger unit 200.

Figure 4D:
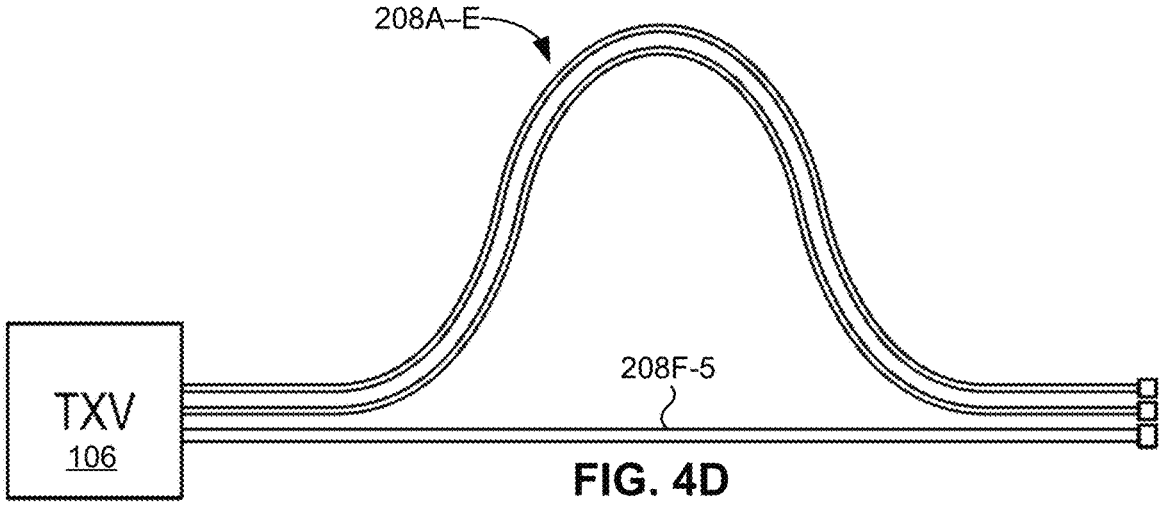
Figure 4E:
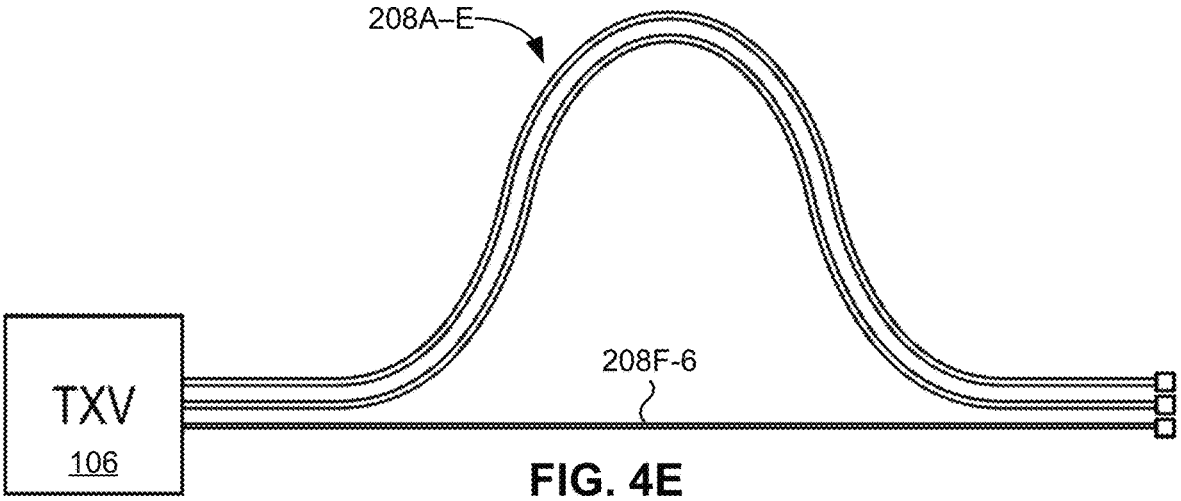

FIG. 4D illustrates a distributor tube 208F-5 having a larger inner diameter than other distributor tubes 208A-E, while FIG. 4E illustrates a distributor tube 208F-6 having a smaller inner diameter than remaining distributor tubes 208A-E. As will be appreciated by one of skill in the art, by increasing the inner diameter of the distributor tube 208F-5, the refrigerant will experience less restrictive forces while flowing through distributor tube 208F-5 and a greater amount of refrigerant can flow through distributor tube 208F-5. Therefore, distributor tube 208F-5 can be connected to a heat exchanger coil 104F that is configured to receive a greater rate of airflow than the remaining heat exchanger coils 104A-E and an amount of refrigerant can be directed away from a heat exchanger coil (e.g., heat exchanger coil 104F) that is starved of airflow and toward a heat exchanger coil (e.g., one or more of heat exchanger coil 104A-E) that is configured to receive a greater amount of airflow. Conversely, by decreasing the inner diameter of the distributor tube 208F-6, the refrigerant will experience more restrictive forces while flowing through distributor tube 208F-6 and a lesser amount of refrigerant can flow through distributor tube 208F-6. Therefore, distributor tube 208F-6 can be connected to a heat exchanger coil (e.g., heat exchanger coil 104F) that is starved of airflow and an amount of refrigerant can be directed from the heat exchanger coil 104F and toward a heat exchanger coil (e.g., one or more of heat exchanger coil 104A-E) that receives a greater amount of airflow. As will be appreciated by one of skill in the art, the inner diameter of the distributor tube 208F can be varied to ensure single-phase vapor refrigerant exits each of the heat exchanger coils 104A-104F. A distributor tube 208F having a suitable inner diameter can be installed by the manufacturer during manufacture of the heat exchanger unit 200 and/or by a technician during installation or maintenance of the heat exchanger unit 200.

Figure 5A:
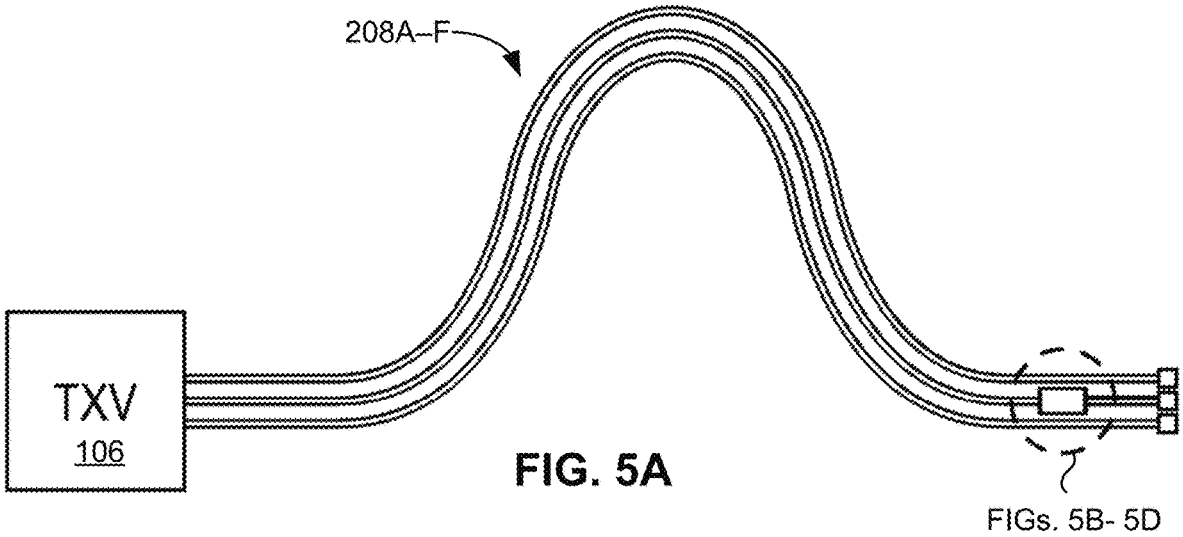
FIGS. 5A-5D illustrate distributor tubes having a constriction, in accordance with the disclosed technology.
Figure 5B:
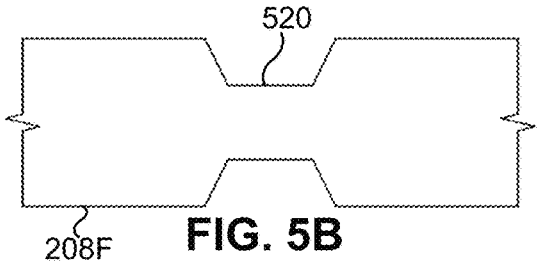
Figure 5C:
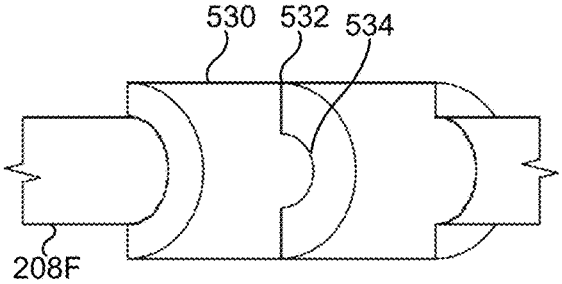
Figure 5D:
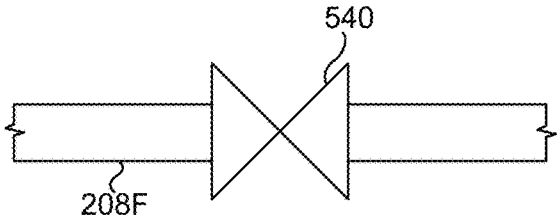

FIG. 5A illustrates a set of distributor tubes 208A-208F connected to the TXV 106 and having one or more constrictions in at least one of the distributor tubes 208A-208F as depicted in FIGS. 5B-5D and as described in detail herein below. As will be appreciated by one of skill in the art, by including a constriction in the line, the refrigerant flowing through the distributor tube (e.g., distributor tube 208F) will experience greater restrictive forces and a lesser amount of refrigerant will flow through the distributor tube. Accordingly, an amount of refrigerant can be directed from a heat exchanger coil (e.g., heat exchanger coil 104F) that is starved of airflow and toward a heat exchanger coil (e.g., heat exchanger coil 104A-E) that receives a greater amount of airflow.

FIG. 5B illustrates a distributor tube 208F that has a constriction 520 that can be formed by pinching, crimping, or otherwise reducing the inner diameter of the distributor tube 208F. The constriction 520 can cause a lesser amount of refrigerant to flow through the distributor tube 208F and a greater amount of refrigerant to flow through the remaining distributor tubes 208A-E. The constriction 520 can be sized to ensure a suitable amount of refrigerant is provide to heat exchanger coils 104A-E that are configured to receive a greater amount of airflow such that refrigerant exiting all of the heat exchanger coils 104A-104F can exit as a single-phase vapor refrigerant. Furthermore, the constriction 520 can be slowly formed (pinched, crimped, etc.) while the heat exchanger 200 is operating until single-phase vapor refrigerant exits each of the heat exchanger coils 104A-104F. The constriction 520 can be formed by the manufacturer during manufacture of the heat exchanger unit 200 and/or formed or adjusted (e.g., increasing the magnitude of a crimp, replacing the refrigerant tube 208 with a new refrigerant tube 208 having a less sever crimp, etc.) by a technician during installation or maintenance of the heat exchanger unit 200.

FIG. 5C illustrates a distributor tube 208F having a constriction that is a flow orifice 530. The flow orifice 530 can include a flow orifice plate 532 that can include an orifice 534 that has a smaller inner diameter than the inner diameter of the distributor tube 208F. The orifice 534 can cause a lesser amount of refrigerant to flow through the distributor tube 208F and a greater amount of refrigerant to flow through the remaining distributor tubes 208A-E. The orifice 534 can be sized to ensure a suitable amount of refrigerant is redirected toward heat exchanger coils 104A-E that are configured to receive a greater amount of airflow such that refrigerant exiting all of the heat exchanger coils 104A-104F can exit as a single-phase vapor refrigerant. Although illustrated as a single-stage flow orifice 530, the flow orifice 530 can be a multi-stage flow orifice having more than one flow orifice plate 532. If the flow orifice 530 includes more than one flow orifice plate 532, each flow orifice plate 532 can have an orifice 534 that has a different inner diameter. As will be appreciated by one of skill in the art, the number of orifice plates 532 and the size of the orifice 534 can be varied for the particular application such that refrigerant exiting all of the heat exchanger coils 104A-104F can exit as a single-phase vapor refrigerant.

FIG. 5D illustrates a distributor tube 208F having a constriction that is a valve 540. The valve 540 can be configured to change an inner diameter of the valve 540 that is installed in line with the distributor tube 208F to reduce the amount of refrigerant that is able to flow through distributor tube 208F. The valve 540 can be a ball valve, a plug valve, a butterfly valve, a gate valve, a globe valve, a needle valve, a coaxial valve, an angle seat valve, or any other type of valve that would be suitable for the particular application. The valve 540 can be manually adjustable or electronically adjustable. As will be appreciated by one of skill in the art, the position of the valve 540 can be adjusted for the particular application such that refrigerant exiting all of the heat exchanger coils 104A-104F can exit as a single-phase vapor refrigerant.

The valve 540 can be electronically adjustable by a controller that is in electronic communication with one or more sensors. One, some, or all of the refrigerant tubes 208 can include a corresponding valve 540. The sensor(s) (e.g., air flow rate sensors) can be configured to monitor airflow rate through the heat exchanger coil slabs 102 (e.g., at specific locations corresponding to one or more of the heat exchanger coils 104A-104F) and transmit flow rate data to the controller. Alternatively or in addition, the sensor(s) (e.g., pressure sensors) can be configured to monitor a pressure of a refrigerant exiting one or more heat exchanger coils 104 of the heat exchanger unit 200 and transmit pressure data to the controller. Based on the flow rate data and/or the pressure data, the controller can determine whether refrigerant flow through one or more of the refrigerant tubes 208 should be adjusted. The controller can thus output instructions for one or more of the valves 540 to adjust (transition to a more open position, transition to a more closed position) based on flow rate data and/or pressure data to provide sufficient refrigerant flow through each refrigerant tube and the corresponding heat exchanger coils 104, thereby providing efficient operation of the heat exchanger unit 200.

Figure 6:
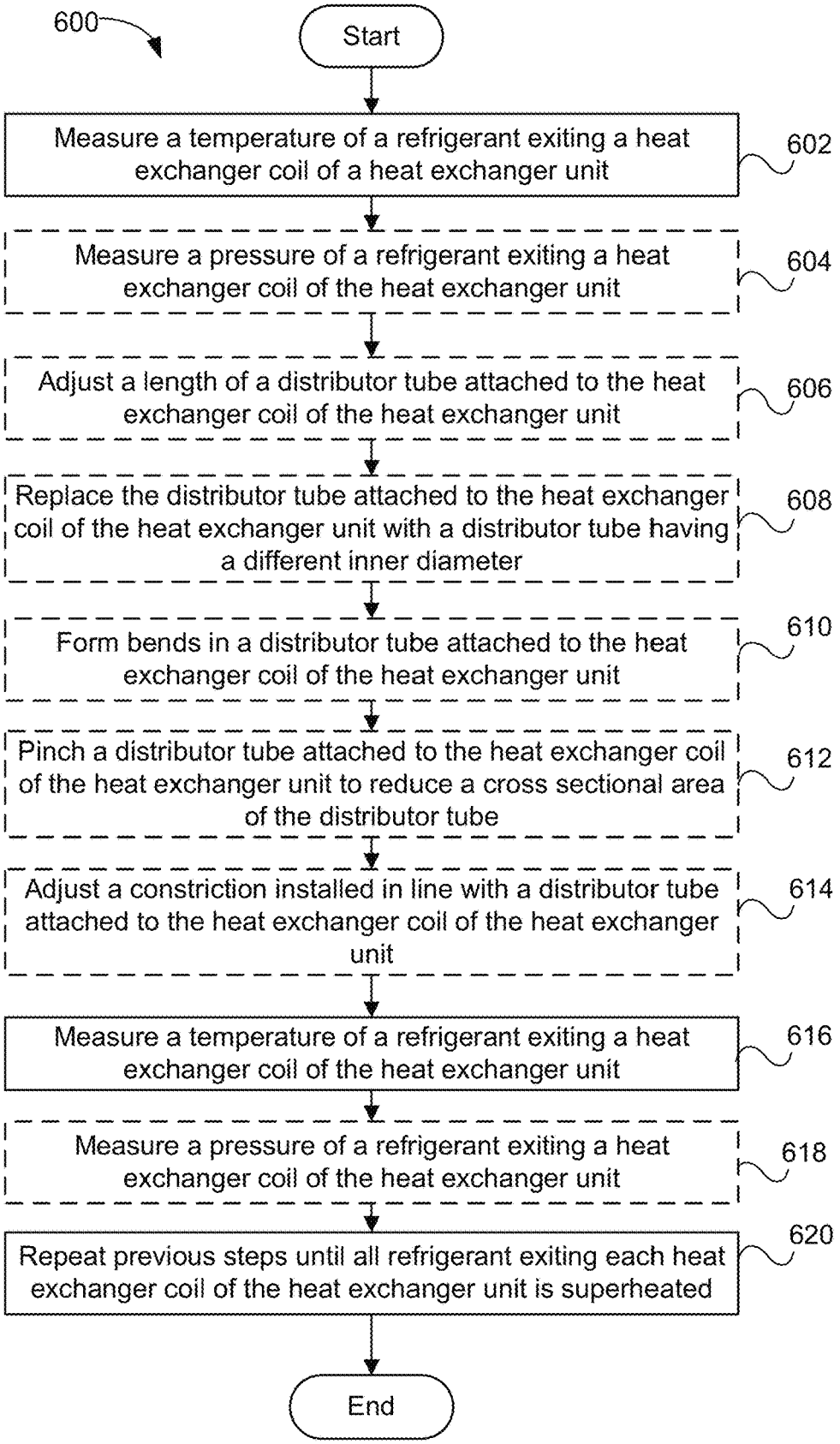
FIG. 6 illustrates a method of optimizing refrigerant flow in a heat exchanger, in accordance with the disclosed technology.

FIG. 6 illustrates a method 600 of optimizing refrigerant flow in a heat exchanger unit (e.g., heat exchanger unit 200). The method 600 can include measuring 602 a temperature of a refrigerant exiting a heat exchanger coil (e.g., heat exchanger coils 104A-104F) of a heat exchanger unit. Alternatively, or in addition, the method 600 can include measuring a pressure of a refrigerant exiting the heat exchanger coil of the heat exchanger unit. The method 604 can include adjusting 606 a length of a distributor tube attached to the heat exchanger coil of the heat exchanger unit. Alternatively, or in addition, the method 600 can include replacing 608 the distributor tube attached to the heat exchanger coil with a distributor tube having a different inner diameter. Alternatively, or in addition, the method 600 can include forming bends in a distributor tube attached to the heat exchanger coil of the heat exchanger unit. Alternatively, or in addition, the method 600 can include pinching 612 a distributor tube attached to the heat exchanger coil of the heat exchanger unit to reduce a cross sectional area of the distributor tube. Alternatively, or in addition, the method 600 can include adjusting 614 a constriction (e.g., flow orifice 530 and/or valve 540) installed in line with a distributor tube attached to the heat exchanger coil of the heat exchanger unit.

After adjusting the flow of the refrigerant through the distributor tube by one or more of the method steps 606-614, the method 600 can include measuring 616 a temperature of the refrigerant exiting the heat exchanger coil of the heat exchanger unit. Alternatively, or in addition, the method 600 can include measuring 618 a pressure of the refrigerant exiting the heat exchanger coil. The method 600 can include repeating 620 the previous steps until all refrigerant exiting each heat exchanger coil of the heat exchanger unit is superheated.

As will be appreciated, the method 600 just described can be varied in accordance with the various elements and implementations described herein. That is, methods in accordance with the disclosed technology can include all or some of the steps described above and/or can include additional steps not expressly disclosed above. Further, methods in accordance with the disclosed technology can include some, but not all, of a particular step described above. Further still, various methods described herein can be combined in full or in part. That is, methods in accordance with the disclosed technology can include at least some elements or steps of a first method and at least some elements or steps of a second method.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. In various aspects of the disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims.

What is claimed is:

1. A heat exchanger unit comprising:

a plurality of heat exchanger coils, wherein (i) a first heat exchanger coil of the plurality of heat exchanger coils is disposed at a first location such that the first heat exchanger coil experiences a first airflow of air passing over the first heat exchanger coil and (ii) a second heat exchanger coil of the plurality of heat exchanger coils is disposed at a second location such that the second heat exchanger coil experiences a second airflow of air passing over the second heat exchanger coil, the first airflow being less than the second airflow;

a plurality of distributor tubes, wherein individual ones of the plurality of distributor tubes (i) being in fluid communication with a corresponding heat exchanger coil of the plurality of heat exchanger coils and (ii) being configured to direct a flow of refrigerant from an expansion valve to the corresponding heat exchanger coil of the plurality of heat exchanger coils, and wherein a first distributor tube of the plurality of distributor tubes extends between the expansion valve and the first heat exchanger coil and comprises one or more constrictions, the first distributor tube has a first cross-sectional area along a majority of an overall length of the first distributor tube, the one or more constrictions has a second cross-sectional area that is less than the first cross-sectional area, and the first distributor tube is configured to reduce a flow rate of refrigerant from the expansion valve to the first heat exchanger coil such that (i) a greater amount of refrigerant is directed to the second heat exchanger coil of the plurality of heat exchanger coils and (ii) refrigerant exits each heat exchanger coil of the plurality of heat exchanger coils as a superheated vapor refrigerant;

wherein the first distributor tube of the plurality of distributor tubes comprises a first number of bends that is greater than a second number of bends in a second distributor tube of the plurality of distributor tubes, and wherein the second distributor tube is shorter than the first distributor tube and a third distributor tube of the plurality of distributor tubes, the third distributor tube being in fluid communication with a third heat exchanger coil of the plurality of heat exchanger coils.

2. The heat exchanger unit of claim 1, wherein the first distributor tube of the plurality of distributor tubes comprises a smaller inner diameter than a second distributor tube of the plurality of distributor tubes.

3. The heat exchanger unit of claim 1, wherein the one or more constrictions is disposed closer to the first heat exchanger coil than the expansion valve.

4. The heat exchanger unit of claim 1, wherein the first distributor tube of the plurality of distributor tubes further comprises a valve configured to change a cross-sectional area of a flow path from the expansion valve to the first heat exchanger coil.

5. The heat exchanger unit of claim 1, wherein the one or more constrictions further comprises a flow orifice.

6. The heat exchanger unit of claim 5, wherein the flow orifice comprises a single-stage flow orifice.

7. The heat exchanger unit of claim 5, wherein the flow orifice comprises a multi-stage flow orifice.

8. The heat exchanger unit of claim 1, wherein the one or more constrictions further comprises a flow orifice.

9. The air conditioning system of claim 8, wherein the flow orifice comprises a single-stage flow orifice.

10. The air conditioning system of claim 8, wherein the flow orifice comprises a multi-stage flow orifice.

11. An air conditioning system comprising:

a compressor;

a condenser unit;

an expansion valve; and an evaporator unit in fluid communication with the compressor, the condenser unit, and the expansion valve, the evaporator unit comprising:

a plurality of heat exchanger coils, wherein (i) a first heat exchanger coil of the plurality of heat exchanger coils comprises a first length and (ii) a second heat exchanger coil of the plurality of heat exchanger coils comprises a second length, the first length being less than the second length;

a plurality of distributor tubes, wherein individual ones of the plurality of distributor tubes (i) being in fluid communication with a corresponding heat exchanger coil of the plurality of heat exchanger coils and (ii) being configured to direct a flow of refrigerant from an expansion valve to the corresponding heat exchanger coil of the plurality of heat exchanger coils, and wherein a first distributor tube of the plurality of distributor tubes extends between the expansion valve and the first heat exchanger coil and comprises one or more constrictions, the first distributor tube has a first cross-sectional area along a majority of an overall length of the first distributor tube, the one or more constrictions has a second cross-sectional area that is less than the first cross-sectional area, and the first distributor tube is configured to alter a flow rate of refrigerant from the expansion valve to the first heat exchanger coil such that (i) a greater amount of refrigerant is directed to the second heat exchanger coil of the plurality of heat exchanger coils and (ii) refrigerant exits each heat exchanger coil of the plurality of heat exchanger coils as a superheated vapor refrigerant;

wherein the first distributor tube of the plurality of distributor tubes comprises a first number of bends that is greater than a second number of bends in a second distributor tube of the plurality of distributor tubes, and wherein the second distributor tube is shorter than the first distributor tube and a third distributor tube of the plurality of distributor tubes, the third distributor tube being in fluid communication with a third heat exchanger coil of the plurality of heat exchanger coils.

12. The air conditioning system of claim 11, wherein the one or more constrictions is disposed closer to the first heat exchanger coil than the expansion valve.

13. The air conditioning system of claim 11, wherein the first distributor tube further comprises a valve configured to change a cross-sectional area of a flow path from the expansion valve to the first heat exchanger coil.

* * * * *